United States Patent [19]

Chen

[11] Patent Number: 4,787,153

[45] Date of Patent: Nov. 29, 1988

[54] SHOE DRIER

[76] Inventor: Yi Chen, No. 209, Sec. 3, Min Tsu Road, Tainan City, Taiwan

[21] Appl. No.: 139,441

[22] Filed: Dec. 30, 1987

[51] Int. Cl.[4] ..... F26B 19/00

[52] U.S. Cl. ..... 34/87; 34/104; 34/239

[58] Field of Search ..... 34/48, 53, 55, 87, 104, 34/106, 239

[56] References Cited

U.S. PATENT DOCUMENTS

| | | | |
|---|---|---|---|
| 2,810,967 | 10/1957 | Jacobus | 34/87 |
| 3,513,564 | 5/1970 | Gramplie | 34/104 |
| 3,775,861 | 12/1973 | Waters et al. | 34/239 X |
| 3,986,272 | 10/1976 | Feierabert | 34/239 X |
| 3,997,978 | 12/1976 | Stuckey | 34/104 |
| 4,198,765 | 4/1980 | Miyamae | 34/104 |

*Primary Examiner*—Steven E. Warner

*Attorney, Agent, or Firm*—Poms, Smith, Lande & Rose

[57] ABSTRACT

A shoe drier has a base, a cap and a U-shaped hanging element. A motor is mounted on the base for driving an impeller to rotate. A heating chamber is disposed on the base for encasing a heater which emits thermal gas for drying a pair of wet shoes. The impeller transmits thermal gas to an upwardly semicircular channel which is complemented by matching a semicircular channel disposed on the cap. The cap has a downwardly semicircular. The U-shaped hanging element has an upper housing, and a first and a second lower housing. The U-shaped hanging element pivotally engages with the circular channels. A plurality of evenly spaced slots are provided on both upper parts of the both wings of the upper housing for guiding thermal gas to flow laterally out of the upper housing.

4 Claims, 5 Drawing Sheets

SHOE DRIER

BACKGROUND OF THE INVENTION

The present invention relates to a shoe drier, and more particularly relates to a shoe drier wherein a U-shaped hanging element is pivotal.

Various types of shoe drier assemblies have been developed in many parts of the world, but not without their drawbacks. The prior art contains a plethora of designs and configurations.

The present invention has arisen from work in seeking to obviate and/or mitigate the drawbacks of the prior art.

SUMMARY OF THE INVENTION

A primary objective of the present invention is to provide a shoe drier with a pivotal U-shaped hanging element.

Another objective of the present invention is to provide a shoe drier wherein the power supply of the shoe drier is cut off when the U-shaped hanging element is put on the base.

Still another objective of the present invention is to provide a shoe drier which has performance characteristics superior to any heretofore available.

Further objectives and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
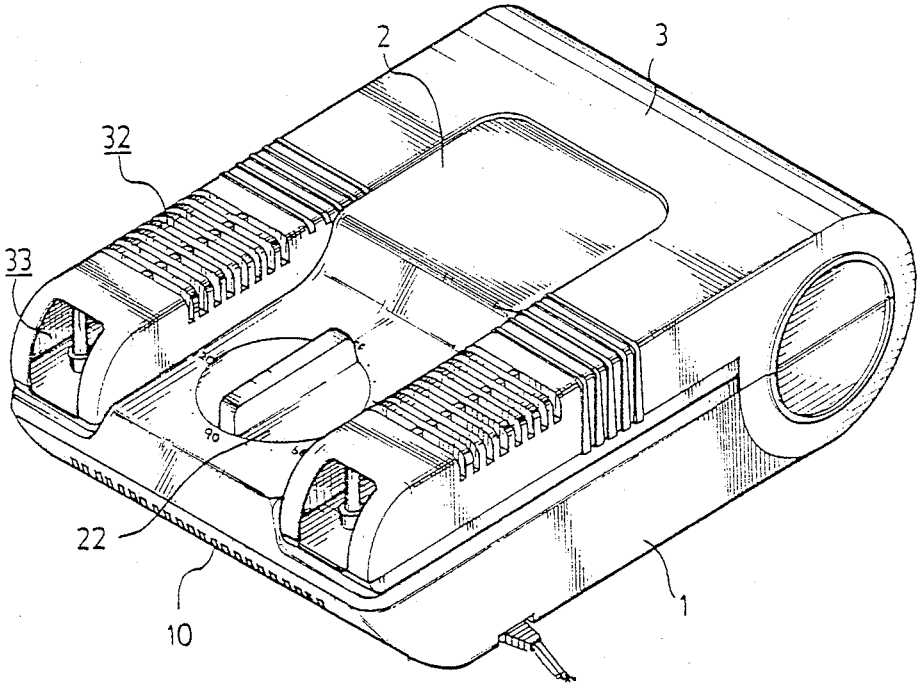
FIG. 1 is a perspective view of a shoe drier in accordance with the present invention.

With reference to the drawings and particularly to FIG. 1 thereof, it can be seen that a shoe drier constructed in accordance with the present invention comprises a base 1, a cap 2 covering the base 1, and a U-shaped hanging element 3.

Figure 2:
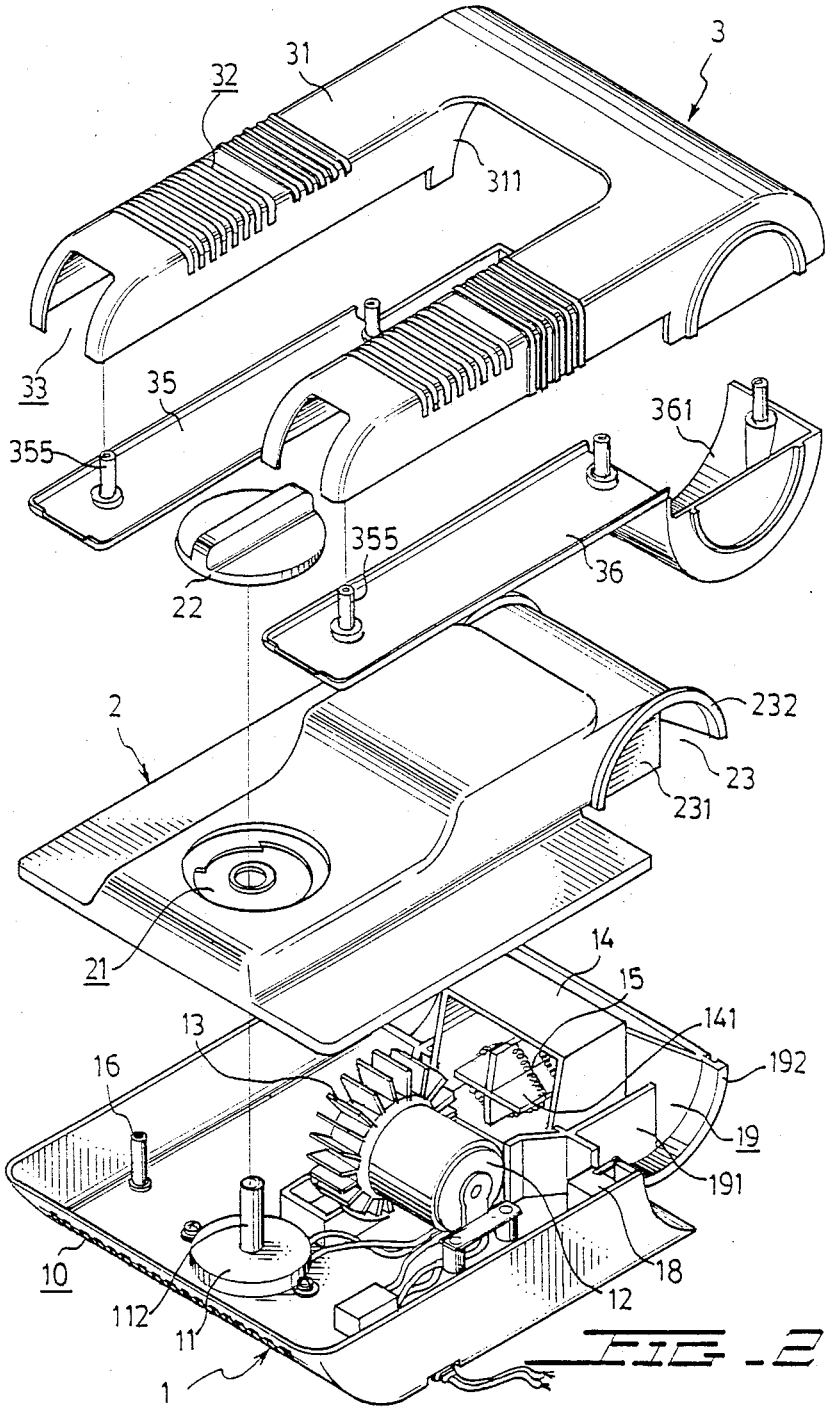
FIG. 2 is an exploded view of the shoe drier of FIG. 1.

Referring to FIG. 2, it can be seen that the base 1 is substantially square with a semicircular channel 19 mounted on central part of an exterior of the base 1. At the bottom end of the opposite side of the base 1 from the semi-circular channel 19, a plurality of evenly spaced slots 10 are provided to admit gas flowing therethrough. A timer 11 with a control bar 112 is threadably fixed on the base 1 for counting a period of time that the shoe drier operates. A motor 12 is mounted adjacent to the timer 11 on the base 1 for driving an impeller 13 to rotate.

Next to the motor 12, a heating chamber 14 is disposed on the conjection of the base 1 and the channel 19. A metal support 141 is disposed within the chamber

14. A heater 15 is encoiled on the support 141 to emit thermal gas for drying a pair of wet shoes. A post 16 is provided on each corner of the base 1 for engaging in a known manner the base 1 and the cap 2.

The cap 2 has a longitudinally raised portion, the shape of which is in accordance with the elements mounted on the base 1. With a hole for the control rod 12 to insert through, a circular concavity 21 is disposed on the raised portion of the cap 2. A dial 22 is received by the concavity 21 for setting a drying period. A semicircular channel 23 is mounted on the terminal of the raised portion, which channel 23 is complemented by matching channel 19 to form a passage.

Since the heating chamber 14 has two open sides which are opposite to each other and are in alignment with the impeller 13, the thermal gas emitted from the heater 15 is transmitted to the passage. Further, a pair of plates 191 are laterally provided beside the chamber 14 on the channel 19. The plates 191 are complemented by matching plates 231 provided on the channel 23 to guide the flow of the thermal gas in the passage.

The shape of the U-shaped hanging element 3 can be seen in FIG. 2. The U-shaped hanging element 3 is detachable into an upper housing 31, and first and second lower housing 35, 36. A plurality of evenly spaced slots 32 are provided on upper parts of both wings of the upper housing 31 for guiding the thermal gas to flow laterally out of the upper housing 31. Likewise, an opening 33 is provided respectively on top center of each wing of the upper housing 31 for the thermal gas to flow out.

The upper housing 31 and the lower housing 35, 36 are combined together by a plurality of screws 355 to form the U-shaped element 3. The U-shaped element 3 pivotally engages with circular rims 191, 232 on the channel 19 and the channel 23, with inner circular rims 311, 351 and 361 of the U-shaped element 3.

Figure 3B:
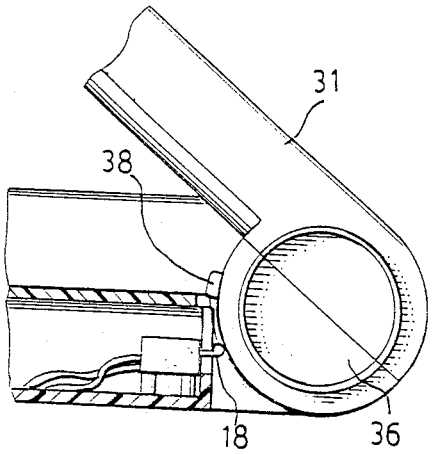
FIG. 3B is a fragmentary view of a base and another lower housing of the shoe drier of FIG. 2.
Figure 3A:
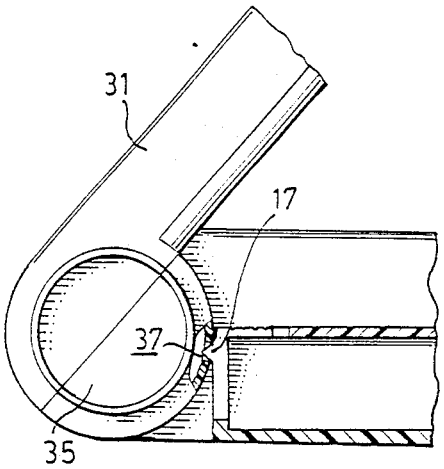
FIG. 3A is a fragmentary view of a base and a lower housing of the shoe drier of FIG. 2.

Referring to FIG. 3A, it can be seen that slit 37 is provided at the arced portion of the first lower housing 35. A hook 17 is disposed on the base 1 for receiving the slit 37, so that the hanging element 3 is held in place for use. The hook 17 is pressed and moved out of the slit 37 so that the hanging element 3 can be put down.

On the other hand, referring to FIG. 3B, it can be seen that a protuberance 38 is provided on the arced portion of the second lower housing 36. A trigger 18 is disposed on the base 1. The shoe drier starts to operate when the protuberance 38 touches the trigger 18. The shoe drier is turned off while the protuberance 38 touches the trigger 18 again, as the hanging element 3 is to be put down.

Figure 4A:
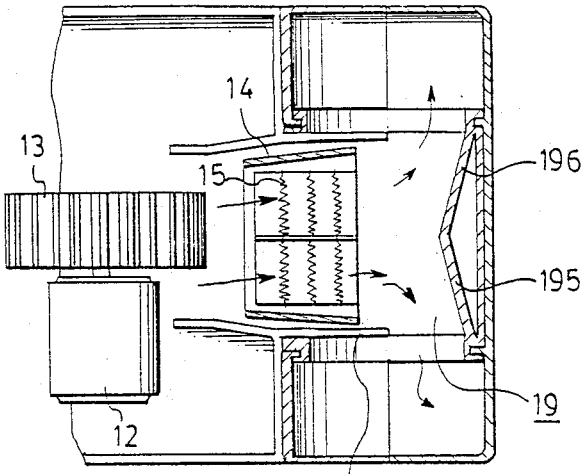
FIGS. 4A and 4B are schematic views illustrating the convection of the thermal gas.

FIG. 4A illustrates the convection of the thermal gas in the base 1. Two planes 195, 196, which slant to wards each other and form one integral piece, are provided in the passage for guiding the thermal gas. Plane 195 is complemented by matching two planes disposed on the channels 19, 23, respectively, when the base 1 and the cap 2 combine together. Similarly, plane 196 is complemented by matching two planes disposed on channels 19, 23, respectively. The rotation of impeller 13 transmits the thermal gas to the passage. This results in the thermal gas quickly spreading to two wings of the hanging element 3 with the guidance of plates 191, 231 and plates 195, 196.

Figure 4B:
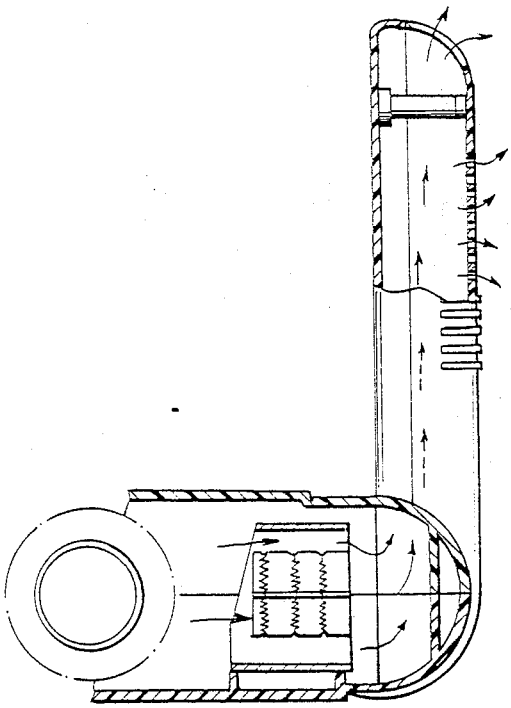

Furthermore, FIG. 4B illustrates the convection of the thermal gas in the hanging element 3. The thermal gas can flow from the slots 32 and the top openings 33 of the hanging element 3.

Figure 5:
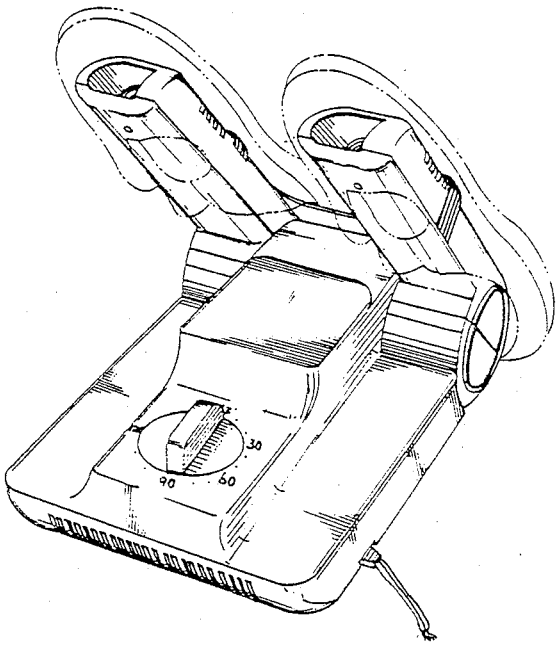
FIG. 5 is a perspective view of a preferred embodiment in accordance with the present invention.

The working embodiment of FIG. 5 shows a pair of shoes, indicated in dotted lines, lifted on the U-shaped hanging element 3.

While the invention has been explained in relation to its preferred embodiment, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A shoe drier comprising:

(a) a base (1) with a semicircular channel (19) mounted on central part of an exterior side of said base (1), wherein a plurality of slots (10) are provided at a bottom end of said base (1) to admit gas flowing therethrough; a timer (11) with a control bar (112) is mounted thereon for counting a period of time; a motor (12) is mounted on said base (1) for driving an impeller (13) to rotate; a heating chamber (14) encases a heater (15) which emits thermal gas for drying a pair of wet shoes; said impeller (13) transmits thermal gas to said semicircular channel (19);

(b) a cap (2) having a circular concavity (21) with a hole for said control rod (112) to insert through; a dial (22) being received by said circular concavity (21) for setting a drying period; a semicircular channel (23) being provided on said cap (2) which channel (23) is complemented by matching said channel (19) to form a passage;

(c) a U-shaped hanging element (3) having an upper housing (31), a first and a second lower housing (35, 36); a plurality of evenly spaced slots (32) being provided on upper parts of two wings of said upper housing (31) for guiding thermal gas to flow laterally out of said upper housing (31); an opening (33) being provided respectively on each top center of each wing of said upper housing (31) for thermal gas to flow out.

2. A shoe drier according to claim 1, wherein: a slit (37) is provided at an arced portion of said first lower housing (35); a hook (17) is disposed on said base (1) for receiving said slit (37) for holding said hanging element (3) in place for use.

3. A shoe drier according to claim 1, wherein: a protuberance (38) is provided on an arced portion of said second lower housing (36); a trigger (18) is disposed on said base 1; said shoe drier starts to operate when said protuberance (38) touches said trigger (18).

4. A shoe drier according to claim 1, wherein: said U-shaped element (3) pivotally engages with circular rims (192, 232) on said channels (19, 23), with inner circular rims (311, 351 and 361) of said U-shaped element (3).

* * * * *